US005150562A

United States Patent [19]

Araki et al.

[11] Patent Number: 5,150,562

[45] Date of Patent: Sep. 29, 1992

[54] METHOD AND APPARATUS FOR PACKAGING RESILIENTLY DEFORMABLE ARTICLES

[75] Inventors: Yozo Araki; Isamu Ito, both of Nagoya; Tohru Sugimura, Kawanoe; Migaku Suzuki, Kawanoe; Mitsuzo Ochi, Kawanoe, all of Japan

[73] Assignees: Mitsubishi Jukogyo Kabushiki Kaisha, Tokyo; Uni-Charm Corporation, Ehime, both of Japan

[21] Appl. No.: 722,499

[22] Filed: Jun. 28, 1991

[30] Foreign Application Priority Data

Jul. 2, 1990 [JP] Japan ..... 2-172663

[51] Int. Cl.[5] ..... B65B 13/20

[52] U.S. Cl. ..... 53/438; 53/456; 53/462; 53/530; 53/575

[58] Field of Search ..... 53/456, 464, 461, 462, 53/439, 438, 436, 526, 528, 530, 207, 575, 576

[56] References Cited

U.S. PATENT DOCUMENTS 3,802,325 4/1974 Bardenhagen et al. ..... 53/575 X
4,241,564 12/1980 Quarenghi ..... 53/575
4,484,432 11/1984 Oberdorf ..... 53/575
4,862,680 9/1989 Krah ..... 53/575

FOREIGN PATENT DOCUMENTS 58-37179 8/1983 Japan .

*Primary Examiner*—James F. Coan
*Attorney, Agent, or Firm*—Robert W. J. Usher

[57] ABSTRACT

In a packaging technique for resiliently deformable articles (such as paper diapers or sanitary napkins), a stack of the articles are packed into a shell-like, inner cassette having an open top and bottom, the inner cassette is wrapped from above with a sheet of film having cardboard flaps extending from respective opposite side margins thereof and the stack of articles is ejected from the inner cassette through the open top, together with the sheet of film into an outer cassette which maintains the partly packed profile. Lower, trailing, flap-form ends of the wrapping extend below the stack on two opposite sides of the cassette, forming flaps that are subsequently folded in overlapping relation to cover the exposed bottom of the stack of articles and heat-sealed together and transversely extending margins of the sheet of film are folded and heat-sealed against the cardboard ends to form a package of predetermined shape.

8 Claims, 6 Drawing Sheets

(A)

(B)

(C)

PRIOR ART

METHOD AND APPARATUS FOR PACKAGING RESILIENTLY DEFORMABLE ARTICLES

FIELD OF THE INVENTION

The invention relates to a method and apparatus for packaging a stack of resiliently deformable articles such as paper diapers into a box-like shape.

BACKGROUND OF THE INVENTION

Japanese disclosure Gazette 1983-37179 discloses a technique for forming a sheet of film into a package $f_5$, as shown in FIG. 8, comprising a tube of rectangular cross-section. Such construction is disadvantageous in that a rear sealing line $f_5$ of double thickness extends along a longitudinal center line of one side and often spoils or detracts from the external appearance causing difficulties in printing. Furthermore, the package is susceptible to deformation when filled with a product and is of inherently poor durability, because the four corners are defined merely by respective folds.

Another well known form of package, shown in FIG. 9, represents an improvement in that the rear sealing line extends along one corner and the remaining three corners are formed with rib-like projections for sealing, obviating the above mentioned disadvantages and resulting in a package of both improved strength and appearance.

However, the packages shown in both FIGS. 8 and 9 were specifically designed to be filled with liquids and it is difficult for such packages to be effectively utilized for packing non-flowable materials such as resiliently deformable articles.

In view of difficulties experienced in attempting to package resiliently deformable articles into a box-shape by using soft film, a conventional approach has been to package the articles as a sheet folded into a square tube i.e., in so-called pillow packaging fashion, or to provide rib-like projections along respective corners of the square tube during formation thereof by the sheet and then to seal such rib-like projections to obtain the box-shape package. However, it is, nevertheless, difficult to package a bunch or stack of soft, resiliently compressible articles such as paper diapers or sanitary napkins into a neat box-shape using such approach.

SUMMARY OF THE INVENTION

One object of the invention is to provide a method and apparatus for packaging a stack or bunch of resiliently deformable articles to provide a neat, predetermined, preferably box-like shape.

Another object of the invention is to provide a packaging method suitable for production at high volume using assembly line techniques.

The invention includes the steps of inserting a stack or bunch of resiliently deformable articles (such as paper diapers or sanitary napkins) into a shell-like, inner cassette having an open top and bottom, wrapping the inner cassette from above with a sheet of film and thrusting the bunch or stack of articles upwardly so that they are ejected from the inner cassette together with the sheet of film, and, preferably transferred into an outer cassette which maintains the partly packed profile. Thin, rigid walls of the inner cassette provide a former enabling the wrapping to be preformed thereon by folding accurately into a shape corresponding to that of the top and sides of the final package while also providing sufficient support to assure reliable heat-sealing of the folded portions of the wrapping thereon and a predictable package dimension.

In addition, a neat, box-shape may be assured by using sheets of relatively stiff film or film-coated cardboard on opposite end surfaces of the package.

Lower, trailing, flap-form ends of the wrapping extend below the stack on two opposite sides of the cassette, forming flaps that are subsequently folded in overlapping relation to cover the exposed bottom of the package and heat-sealed together while transversely extending margins of the sheet of film are folded and heat-sealed against the cardboard ends. Such operation is carried out while the package remains in the outer cassette in order to maintain the package in the desired shape.

The steps of folding the trailing flaps over the bottom of the package and folding the transverse margins and heat sealing are carried out by utilizing the outer cassette so that reliability may be assured by presetting the successive positions of the respective machine components for carrying out the operations.

More specifically, according to the invention, a method for packaging resiliently deformable articles comprising the steps of: providing an inner cassette having an open top and bottom and pairs of opposite end and side surfaces extending therebetween; inserting a stack of resiliently deformable articles into the inner cassette; placing a rectangular sheet of film having rectangular cardboard flaps affixed thereto along respective middle portions of opposite sides thereof on the open top of the inner cassette; sheet of film, bringing said cardboard flaps into covering engagement with opposite end surfaces of the inner cassette and bringing flaps defined by portions of said sheet of film into covering engagement with opposite side surfaces of the inner cassette and then sealing margins projecting outwardly from the respective side surfaces of the inner cassette onto said cardboard flaps; providing an outer cassette; aligning the inner and outer cassettes; thrusting the stack of the resiliently deformable products together with the film sheet and the cardboard flaps extending over the inner cassette upwardly through the open top out from said inner cassette into the outer cassette; and, folding, overlapping and sealing lower ends of the respective film flaps.

According to another aspect of the invention, apparatus for packaging resiliently deformable articles comprises an inner cassette made of rigid sheet material and having an open top and bottom between which extend opposite pairs of side and end wall surfaces; means for inserting a stack of resiliently deformable articles into said inner cassette; a rectangular sheet of film having rectangular cardboard flaps affixed thereto along respective middle portions of opposite sides thereof; means for placing said sheet of film on the top of the inner cassettes; means for folding by forcing said cardboard flaps and said sheet of film downwards against the end and side surfaces of the inner cassette, respectively; means for folding and sealing transverse margins of said sheet of film onto the respective cardboard flaps; an outer cassette having an open bottom and means for moving the outer cassette between a loading position above said inner cassette and a discharge position at which the products are discharged from the outer cassette; means for thrusting the stack of articles together with the folded sheet of film and cardboard flaps upwardly from said inner cassette into said outer cassette;

means for folding, overlapping and sealing lower ends of the respective film flaps; and, means for thrusting the packaged stack of articles downwardly, out from the outer cassette at said discharge position.

BRIEF DESCRIPTION OF DRAWINGS

A specific embodiment of the invention will now be described by way of example only and with reference to the accompanying drawings in which.

DESCRIPTION OF PREFERRED EMBODIMENT

Figure 1:
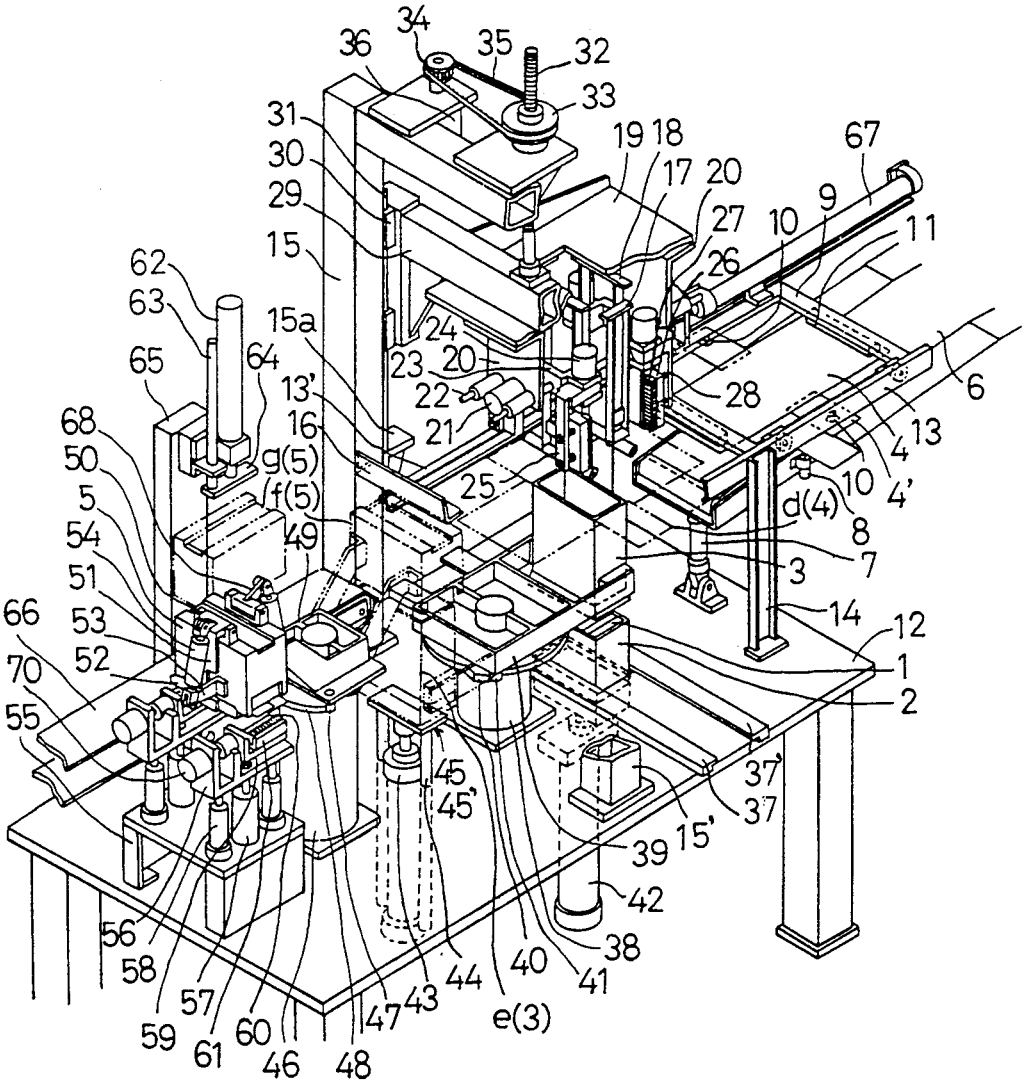
FIG. 1 is a perspective view of a packaging machine according to the invention.
Figure 2:
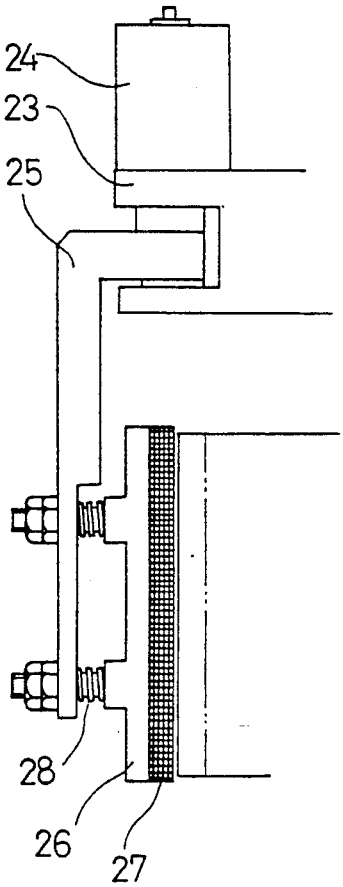
FIG. 2 is a fragmentary view of the front of a heat-sealer shown in FIG. 1.

A group of resiliently deformable articles to be packaged consists of a stack 1 of approximately one dozen paper diapers which are loaded in a conveying cassette 2 for conveying to the packaging machine. Alternatively, a bucket conveyer provided with box-like containers having configurations different from that illustrated may be utilized. An inner cassette 3 is mounted on a turntable 39 (FIG. 1) at a first packaging station for receipt of the stack of paper diapers from the conveying cassette 2. As shown particularly in FIG. 1 and FIG. 5(*c*), a packaging film 4 has rectangular cardboard flaps 4' affixed (by heat-sealing) on both sides thereof and is formed at locations aligned with opposite ends of the respective cardboard flaps 4' with severances sufficiently deep to extend across each margin for heat-sealing, and further additional severances at positions spaced from the first-mentioned severances, respectively, by a distance equal to the length of the respective flaps 4'.

As shown particularly in FIGS. 5(E) and (H), longitudinal and transverse margins which have been folded and heat-sealed are shown at a and b, respectively.

All mechanisms for packaging are mounted on a main frame table 12.

Guide rails 37, 37' for the conveying cassette 2 extend from one edge of the table to a location immediately below and adjacent an inner cassette 3 at the packaging station and an air cylinder 42 is mounted below the table aligned with the inner ends of the guide rails for entry of a piston thereof into a lower open end of the conveying cassette to thrust the stack of paper diapers from the conveying cassette up into the inner cassette 3.

A packaging film feeder comprises a conveyor 6 mounted to extend across and above the surface of the table on an air cylinder 7 to feed the film 4 from the right hand, as viewed in FIG. 1, transversely of the rails 37, 37.' A photo-electric switch is mounted on a stationary frame part of the conveyor for sensing the presence of the cardboard flaps 4' and arresting the film feed at a predetermined position.

A film transfer mechanism for transferring the sheet of film from the conveyer to the packaging station comprises rails 13 supported above the table by piers 14 and extending from the inner, exit end of the conveyer to the packaging station and a moveable frame 9 having film suction disks 10 and 11 thereon, and mounted on rollers provided on both sides thereof riding on the rails. An air cylinder 67 mounted on the table is operatively connected to one side of the frame 9 for advancing the frame with the packaging film, held by the suction disks 10 and 11, to the packaging station.

It will be appreciated that alternative film feeding means such as a vacuum belt type or a gripping type may be used.

A mechanism for folding or tucking and sealing the film around the inner cassette is supported by piers 15, 15' which upstand from opposite side of the table 12 and are connected by a cross-head.

The wrapping mechanism comprises four sets of heat-sealers 27 mounted on sealer bases 26 with insulating material interposed. Each sealer base 26 is slidably mounted on the shank of a bolt carried by a rotatable lever 25 against the action of a bolt mounted compression spring 28 enabling automatic adjustment of the precise position of the sealer base so that engagement with the entire length of the associated sealing surface during operation of the sealer 27 is maintained. A pair of air-driven rotatable actuators 24 are connected to respective ends of levers 25 for rotating them through 90° to sealing locations and are supported by a carriage 23 which also supports the respective levers 25. An air cylinder 21 carried by a vertically extending mount 20, itself carried by a mount plate 19, is operatively connected to the carriage to move the carriage towards and away from an object to be packaged. The carriage is supported on tilt preventing guide rods 22 extending therefrom slidably mounted in the mount 20. The mount plate 19 also carries a cardboard folding tool 17 provided at a lower end with pressure applying rollers and linked for reciprocal vertical movement to an air cylinder (not shown), and a film folding tool 18 similarly linked for reciprocal vertical movement by an air cylinder, (not shown). The mount plate 19 is mounted on a cross beam 29 provided on respective opposite ends with linear guides 30 mounted for vertical sliding movement along guide rails 31, secured to the respective piers 15 and 15'.

A vertically extending, threaded shaft 32 supports the mount plate 19 together with the cross beam 29. A reduction motor 36 (having a safety clutch) is mounted on the cross head at the upper portion of the pier 15 and is operatively connected through a belt drive comprising a gear 34 and follower gear 34 linked by a toothed belt 35 mounted on the cross head, the follower gear 33 having a female screw meshed with the shaft 32 thereby to rotate the shaft and raise and lower the entire packaging/sealing mechanism around the inner cassette 3. A lower stopper 15*a* extends from a side of the pier or slide to limit such vertical movement.

As mentioned above, the inner cassette 3 is mounted on turntable 39 carried by the frame table 12 for rotary and translational movement through 180° from the first packaging station to an article transfer station, indicated by two-dot-chain-line (3), where the articles are transferred from the inner cassette to the outer cassette. As shown, the turntable comprises a support cylinder 38 secured to the table 12 and containing a bearing for a spindle of the turntable 39. A positioning cam plate 40 is secured to the support cylinder 38 and a positioning pin 41 is mounted on the turntable 39. The spindle of the turntable 39 is driven by a reduction motor (which includes a safety clutch, not shown), mounted to depend below the main table 12. Reversal of the motor restores the inner cassette 3 to the initial article receiving position.

A mechanism for wrapping by tucking and sealing the packaging sheet around the bottom and lower sides of the stack of articles while received in the outer cassette 5 will now be described.

The outer cassette 5 is mounted at a higher level than the inner cassette on a turntable 49 for horizontal rotation through an angle of 180° between the positions indicated in solid and two-dot-chain-line f(5). The turntable 49 is supported by a bearing mounted on the main table 12 and containing cylinder 46 housing the turntable spindle. A positioning cam plate 48 is secured to the bearing containing cylinder 46 and a positioning pin 47 is mounted on a turntable 49. The turntable 49 has a drive shaft projecting downwards from the bottom of the bearing containing cylinder 46 and driven by a reduction motor including a safety clutch (not shown).

Figure 4B:
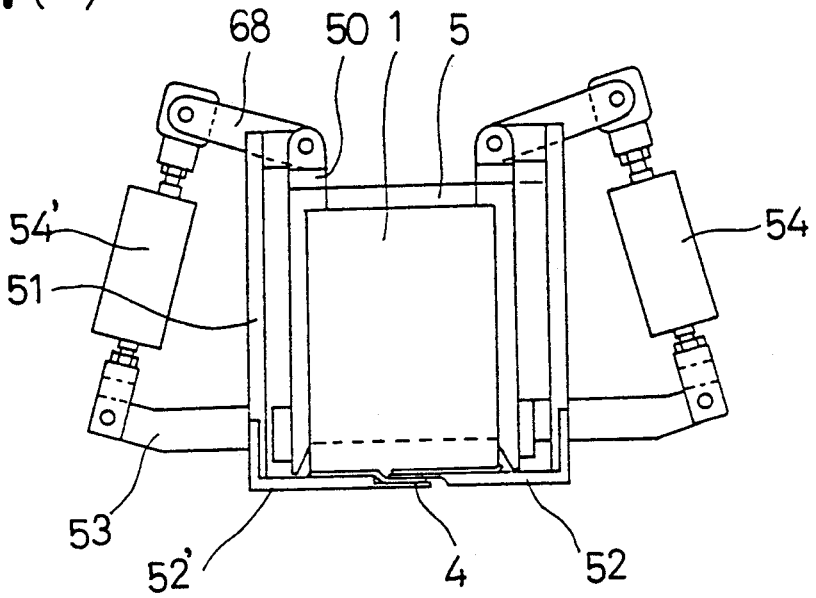
FIGS. 4(*a*) and (*b*) are fragmentary views of the outer cassette and associated film folding or tucking mechanism at successive stages in operation.
Figure 4A:
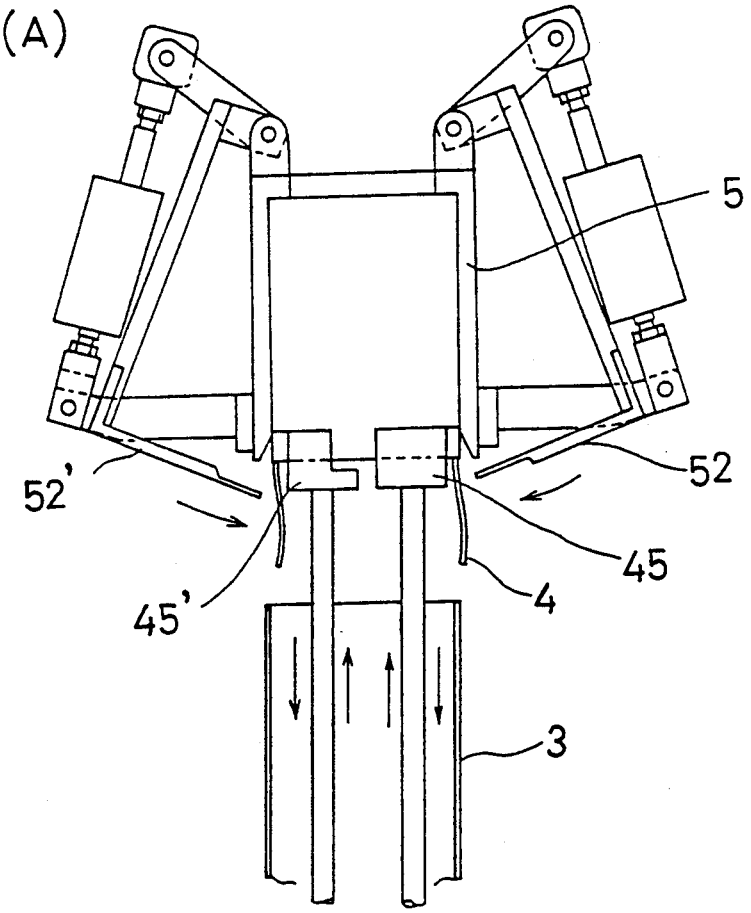

The outer cassette 5 has a pair of lugs 50 upstanding from opposite sides of an upper end. Arms 51 are pivotally mounted at one of their ends on the respective lugs 50 and their other ends carry fingers 52 operable to tuck or fold opposite lower sides of the packaging sheets 4 inwardly, as shown in FIG. 4. Outwardly projecting links 68, integral at respective upper ends with the arms 51, carry air cylinders 54 and have lower ends pivotally connected to arms 53 which outstand from opposite lower sides of the cassette 5.

A pedestal 55, mounted on the table 12, supports a pair of air cylinders 57 and two pairs of sliding guide rods 58. A supporting frame 56 is operably mounted on the air cylinders 57 and carries an air-driven, rotatable actuator 70 operable to rotate a turntable 49, a sealer carriage 61 and a sealer 60 through 90° to the position indicated in two-dot-chain-line g(5) at which completely wrapped or packaged paper diapers are ejected from the outer cassette 5 to a belt conveyer 66 supported adjacent one edge of the table. The ejection mechanism includes a plate 64 carried by air cylinder 62 and mounted on an anti-rotation slide rod 63 supported by pier 6 upstanding from the table for downward movement into engagement with the articles through an aperture in the top of the outer cassette.

Figure 5:
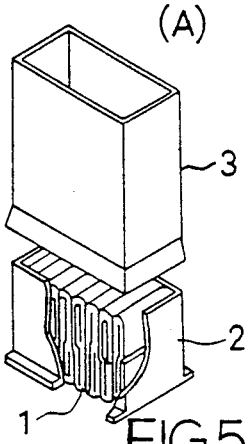
FIGS. 5(*a*)–(*i*) illustrate, schematically, successive steps of packaging according to the invention.
Figure 5:
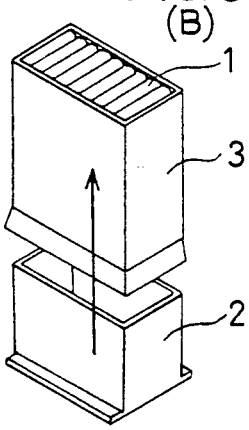
Figure 5:
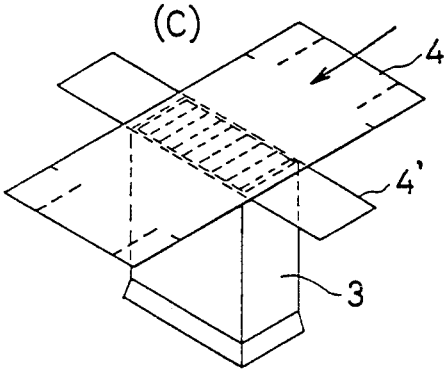
Figure 5:
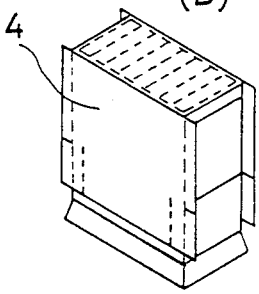
Figure 5:
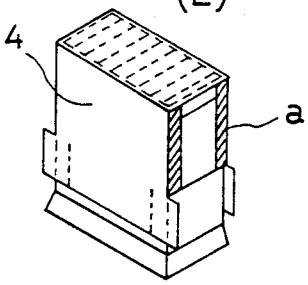
Figure 5:
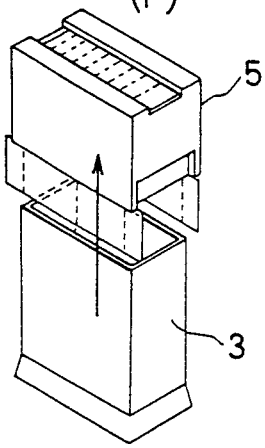
Figure 5:
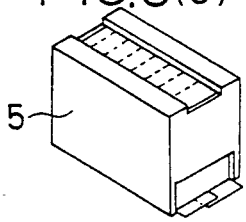
Figure 5:
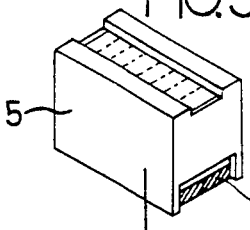
Figure 5:
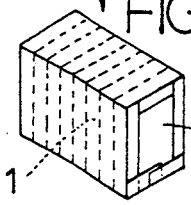

Successive packaging steps (a)–(i) are illustrated schematically in FIG. 5 which should be reviewed in conjunction with FIG. 1.

(a) Articles, such as paper diapers, stacked in face-to-face are firstly packed into the conveying cassette 2 and fed along the guides 37, 37' on the main table to a position aligned immediately below the inner cassette 3.

(b) The articles are then thrust all together as a bunch or stack from the conveying cassette upwardly into the inner cassette 3 by the action of the air cylinder 42

(c) The packaging film 4 is fed to a position above the inner cassette 3 in two stages. Firstly, the film 4 is conveyed by the conveyer 6 which is stopped at a predetermined position detected by the photo electric switch 8 and then raised together with the conveyer 6 by operation of the air cylinder 7 to a location adjacent suction disks 10 and 11. The film 4 is then removed from the conveyer 6, held by the suction disks 10 and 11, mounted on the moveable frame 9, extending horizontally. The conveyor 6 is then lowered, by action of the cylinder 7, ready for reception of the next sheet. The moveable frame is then advanced along the rails 13 and 13' by the operation of the air cylinder 67, feeding the film to the position aligned immediately above the inner cassette 3 and shown by two-dot-chain-line d(4).

(d) The folding tool 17 is then lowered by the associated air cylinder (not shown) and the vacuum source is disconnected from the suction disks 10 and 11 so that the cardboard flaps 4' may be folded onto the opposite end surfaces of the inner cassette 3. The folding tool 18 is then lowered, (it being unnecessary to switch off the suction disks from the vacuum source), by the associated air cylinder (not shown) so that the film flaps 4 are folded thereby onto the opposite side surfaces of the inner cassette. Thereafter, the drive mechanism including drive motor 36, pulleys 33 and 34 and drive belt 35 are operated to rotating the screw 32 and thereby lower the mount plate 19 carrying the sealer 27 to the position of the inner cassette 3.

Figure 3:
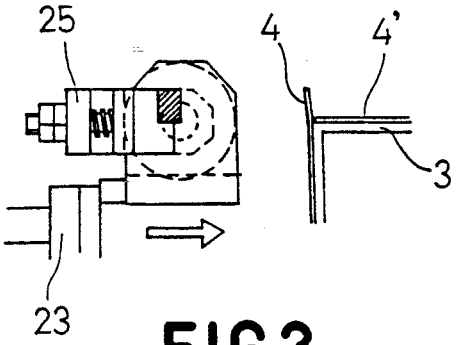
FIGS. 3(*a*),(*b*) and (*c*) are bottom views illustrating successive steps of operation of the heat-sealer.
Figure 3:
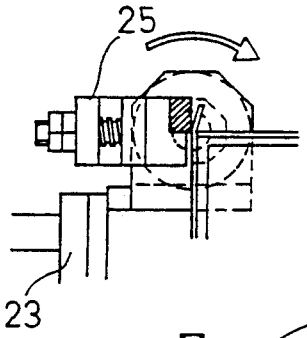
Figure 3:
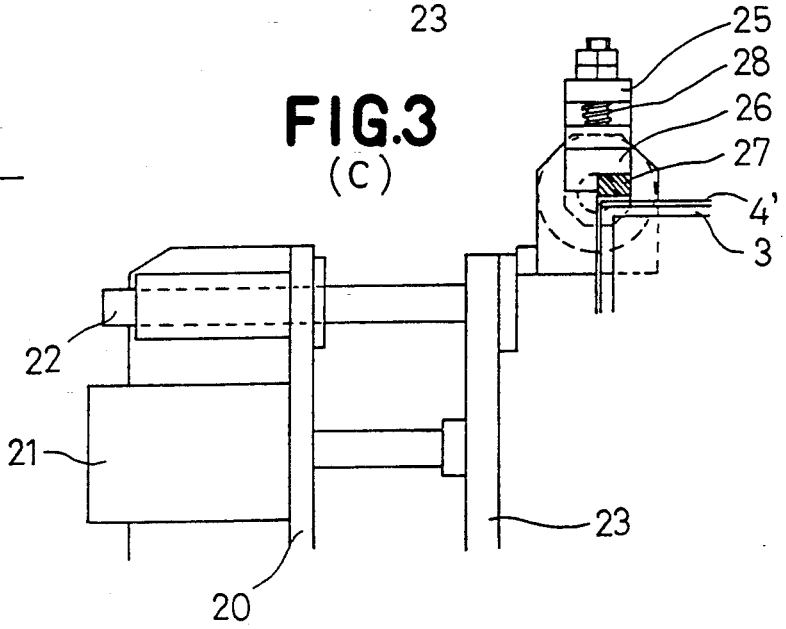

(e) The respective margins of the film flaps 4, (each having a length equal to that of respective cardboard flaps 4'), are then folded along the associated edges of the inner cassette 3 onto the respective cardboard flaps 4' and the respective margins a are heat-sealed onto the respective cardboard flaps 4'. This operation is effected by operating air cylinder 21 to advance the carriage 23 from the position shown in FIG. 3(A) to that shown in FIG. 3(B), adjacent, but spaced from, the inner cassette. The rotatable actuator 24 is then operated to rotate the sealer 27, folding the margins of the film flaps to trap the cardboard flaps 4', sandwiched between said margins and the inner cassette 3. Subsequently, the heat-sealing is performed (FIG. 3(*c*)). On completion of heat-sealing, the rotatable actuator 24 is activated to restore the sealer 27 to its initial position, the air cylinder 21 is activated to withdraw the carriage 23 from the inner cassette 3 and the motor 36 is reversely rotated to raise the mount plate together with sealer 27 mounted thereon. Simultaneously, the folding tools 17 and 18 are also raised by the associated air cylinders, (not shown), in readiness for the next cycle of operations. The air cylinder 67 is also activated to withdraw the moveable frame 9 to the initial position.

(f) The inner cassette 3 is then moved to a position immediately below the outer cassette 5 and the articles, together with the packaging film thrust up into the outer cassette 5, as described below.

The inner cassette 3 is rotated through 180° by the turntable 39 to the position indicated by two-dot-chain-line e(3). The outer cassette 5 is rotated by the turntable 49 through 180°, (in an opposite rotational sense), to the position indicated by two-dot-chain-line f(5), bringing the cassettes 3 and 5 into precise alignment, one below the other. The stack of articles 1 is then thrust by pushing plates 45, 45' (FIG. 4) mounted on a pair of air cylinders 43, (only one of which is shown in FIG. 1), up from the inner cassette 3 into the outer cassette 5. It should be understood that, during such operation, the folding or tucking arms 52, 52' mounted on the outer cassette 5 are at the positions shown by FIG. 4(*a*).

(g) The folding of the film flaps 4, as illustrated in FIG. 4, is accomplished by firstly lowering the one pushing plate 45, actuating the air cylinder 54 to move the arm 52 to fold the right film flap 4 and, then lowering the pushing plate 45' and operating the air cylinder 54' to move the arm 52' to fold the left film flap 4 to complete wrapping of the stack of articles.

(h) The film margins (b), projecting outward from the opposite end surfaces of the outer cassette 5, are then folded upwardly and heat-sealed onto the respective cardboard flaps 4'. In this operation, the supporting frame 56 is raised from the position shown in FIG. 5(G) by the air cylinder 57 to a position closely adjacent, but spaced from, the bottom of the outer cassette 5. The rotatable actuator 70 is then activated, rotating the heat-sealer 60 to heat-seal respective film margins onto respective cardboard flaps 4'. On completion of heat-sealing, the rotatable actuator 70 withdraws the sealer 60 to its initial position and the air cylinder 57 is operated to lower the supporting frame 56 for the sealer 60 back to its initial position.

(i) Finally, the packaged stack of paper diapers is ejected from the outer cassette 5. Prior to such ejection, the turntable 49 is rotated through 90° from the packing position to the position indicated by two-dot-chain-line g(5) and the air cylinder 62 operated to lower thrust plate 64 through a central aperture in a top wall of the cassette, thrusting the packaged stack out from the cassette onto the conveyor 66.

Figure 6:
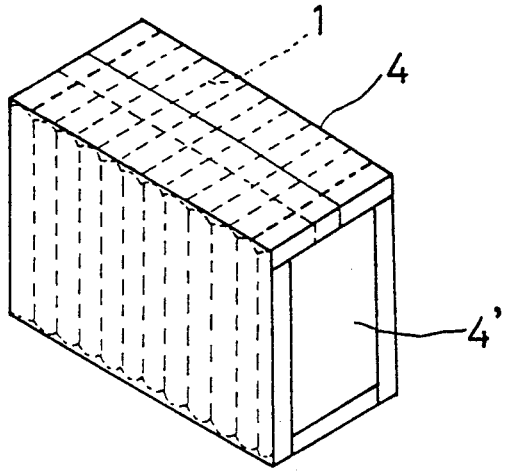
FIG. 6 is a perspective view of a finished package obtained by the steps illustrated in FIG. 5.
Figure 7:
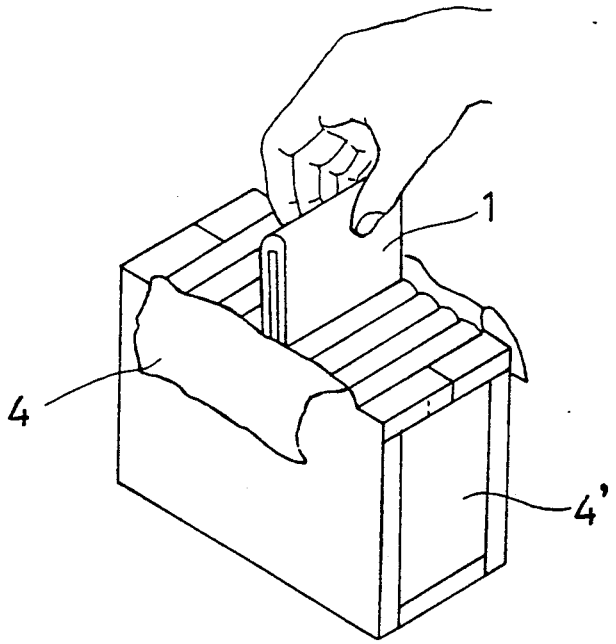
FIG. 7 is a perspective view illustrating the manner in which an individual product or article is removed from the finished, opened package.
Figure 8:
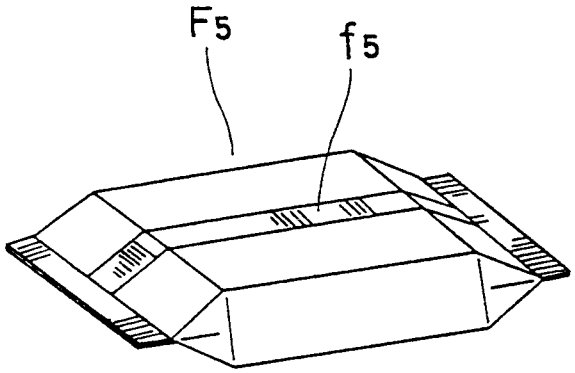
FIG.8 PRIOR ART
FIG. 8 is a perspective view of a known package.
Figure 9:
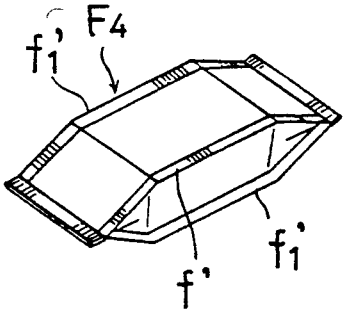
FIGS. 9(*a*) and (*b*) are perspective views of other examples of well known packages.
Figure 9:
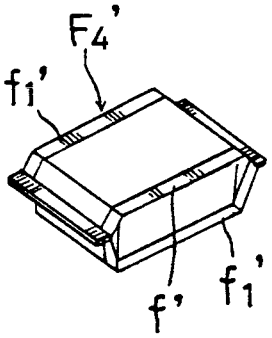
PRIOR ART FIG.9 (B)

The final form of the packaged stack of paper diapers 1 is illustrated by FIG. 6, and, as shown in FIG. 7, individual articles may be removed manually from the package one-by-one through an opening defined by tearing back the overlapping film flaps.

The invention may be utilized for packaging other resilient or elastic articles or products of indeterminate shape.

We claim:

1. A method for packaging resiliently deformable articles comprising the steps of:

providing an inner cassette having an open top and bottom and pairs of opposite end and side surfaces extending therebetween;

inserting a stack of resiliently deformable articles into the inner cassette;

placing a rectangular sheet of film having rectangular cardboard flaps affixed thereto along respective middle portions of opposite sides thereof on the open top of the inner cassette; folding said sheet of film, bringing said cardboard flaps into covering engagement with opposite end surfaces of the inner cassette and bringing flaps defined by portions of said sheet of film into covering engagement with opposite side surfaces of the inner cassette and then sealing margins projecting outwardly from the respective side surfaces of the inner cassette onto said cardboard flaps;

providing an outer cassette;

aligning the inner and outer cassettes;

thrusting the stack of the resiliently deformable products together with the film sheet and the cardboard flaps extending over the inner cassette upwardly through the open top out from said inner cassette into the outer cassette; and, folding, overlapping and sealing lower ends of the respective film flaps.

2. Apparatus for packaging resiliently deformable articles comprising:

an inner cassette made of rigid sheet material and having an open top and bottom between which extend opposite pairs of side and end wall surfaces;

means for inserting a stack of resiliently deformable articles into said inner cassette;

a rectangular sheet of film having rectangular cardboard flaps affixed thereto along respective middle portions of opposite sides thereof;

means for placing said sheet of film on the top of the inner cassettes;

means for folding by forcing said cardboard flaps and said sheet of film downwards against the end and side surfaces of the inner cassette, respectively;

means for folding and sealing transverse margins of said sheet of film onto the respective cardboard flaps;

an outer cassette having an open bottom and means for moving the outer cassette between a loading position above said inner cassette and a discharge position at which the products are discharged from the outer cassette;

means for thrusting the stack of articles together with the folded sheet of film and cardboard flaps upwardly from said inner cassette into said outer cassette;

means for folding, overlapping and sealing lower ends of the respective film flaps; and, means for thrusting the packaged stack of articles downwardly, out from the outer cassette at said discharge position.

3. Apparatus for packaging resiliently deformable articles comprising:

a supporting table frame;

an inner cassette made of rigid sheet material and having an open top and bottom between which extend opposite pairs of side and end wall surfaces;

means mounted on the table for supporting the inner cassette in an article receiving and wrapping position;

means mounted on the table below the inner cassette for inserting a stack of resiliently deformable articles into said inner cassette;

a rectangular sheet of film having rectangular cardboard flaps affixed thereto along respective middle portions of opposite sides thereof;

conveyor means for feeding said sheets of film successively to the table and means for transferring the sheets of film successively from the conveying means to the top of the inner cassette;

means mounted on the table for engaging over said cardboard flaps and sheet of film for folding said cardboard flaps and sheet of film downwards against the end and side surfaces of the inner cassette, respectively;

means mounted on the table in association with the folding means for folding and sealing transverse margins of said sheet of film onto the respective cardboard flaps while engaged by the folding means;

an outer cassette having an open bottom and means mounted on the table for moving the outer cassette between a loading station above said inner cassette and a discharge station at which the packaged articles are discharged from the outer cassette;

means mounted on the table below the outer cassette loading station for thrusting the stack of articles together with the folded sheet of film and cardboard flaps upwardly from said inner cassette into said outer cassette;

means for folding, overlapping and sealing lower ends of the respective film flaps; and, mounted on the table at the discharge station for thrusting the packaged stack of articles downwardly, out from the outer cassette at said discharge position.

4. Apparatus according to claim 3 in which the means for supporting the inner cassette comprises a first turntable and the means for moving the outer cassette comprises a second turntable, the first and the second turntables being mounted on the table in spaced apart relation and being operable, respectively, to swing the inner cassette between an article receiving position and an article transferring position, and to swing the outer cassette between the first loading, position and the second, discharge position.

5. Apparatus according to claim 4 in which the outer cassette includes a pair of arms mounted depending from respective opposite sides thereof and having inwardly directed fingers at respective lower ends and means for pivoting the arms away from and towards the cassette thereby moving the fingers apart, to a location remote from the bottom of the cassette and together, extending across the bottom of the cassette, in article receiving and film folding positions, respectively, the ejection means being synchronized for upward movement to transfer the stack and wrapping from the inner cassette to the outer cassette when the fingers are remote from the bottom thereof in the article receiving position.

6. Apparatus according to claim 5 in which the transverse margin folding and sealing means comprises a carriage mounted for movement between positions remote from and adjacent the inner cassette, and folding and sealing means rotatably mounted on the carriage and means on the carriage for rotating the folding and sealing means, when adjacent the inner cassette to fold the transverse film margins onto the cardboard and to seal the film thereon.

7. A method of packaging a bunch of resiliently compressible pad-like articles by confining the bunch in a former having at least one open end and sides extending away from the open end forming an external shape corresponding to the shape of the desired package; providing sheet material including stiff panels extending from opposite sides thereof aligned to wrap one pair of opposite sides of the bunch to define the cross-sectional profile between such sides; wrapping the sheet material over the open end and securing the sheet material together around the sides in a sliding fit with free end portions of the sheet material extending beyond an opposite end of the bunch of articles; providing a holder having an open end and an internal shape for receiving the wrapped end of the bunch as a sliding fit; aligning the wrapped end of the former and the open end of the holder and feeding the bunch, wrapped end first, through an open end of the former into the holder, thereby drawing the wrapping sheet from the former into wrapping engagement with the bunch; wrapping by folding and securing free end portions of the sheet material together about the other, unwrapped end of the bunch.

8. A method according to claim 7 in which the sheet material is secured around the sides of the former with free side edge portions of the sheet material extending beyond the sides of the former with which they are in a sliding fit and the free side edge portions are folded and secured to the respective stiff panels prior to the wrapping sheet being drawn from the former into wrapping engagement with the bunch.

* * * * *

UNITED STATES PATENT AND TRADEMARK OFFICE

CERTIFICATE OF CORRECTION

PATENT NO. : 5,150,562

DATED : September 29, 1992

INVENTOR(S) : Araki et al

It is certified that error appears in the above-indentified patent and that said Letters Patent is hereby corrected as shown below:

Column 8, line 67, "mounted" should read --means mounted--.

Signed and Sealed this

Seventh Day of September, 1993

Bruce Lehman

*Attest:*

BRUCE LEHMAN

*Attesting Officer*

*Commissioner of Patents and Trademarks*